United States Patent [19]

Borst et al.

[11] Patent Number: 4,471,728

[45] Date of Patent: Sep. 18, 1984

[54] PRESSURE-CONTROLLED STROKE LIMITER

[75] Inventors: Gaylord M. Borst; Frank J. Walsworth, both of Waukegan, Ill.

[73] Assignee: Outboard Marine Corporation, Waukegan, Ill.

[21] Appl. No.: 492,557

[22] Filed: May 9, 1983

[51] Int. Cl.[3] ..... F01M 3/00; F02B 33/06

[52] U.S. Cl. ..... 123/73 AD; 123/73 R

[58] Field of Search ..... 123/73 AD, 73 R

[56] References Cited

U.S. PATENT DOCUMENTS

| | | | |
|---|---|---|---|
| 3,653,784 | 4/1972 | Leitermann et al. | 123/73 AD |
| 4,381,741 | 5/1983 | Walsworth | 123/73 AD |
| 4,383,504 | 5/1983 | Walsworth | 123/73 AD |

*Primary Examiner*—Wendell E. Burns

*Attorney, Agent, or Firm*—Michael, Best & Friedrich

[57] ABSTRACT

A two-stroke internal combustion engine of the type having separate fuel and oil pumps delivering their outputs for mixture prior to entering the carburetor, the oil pump having a variable output relative to the fuel pump output, and means responsive to the amplitude of the pressure wave in the engine crankcase to vary the output of the oil pump to optimize the fuel/oil ratio for the operating conditions.

10 Claims, 1 Drawing Figure

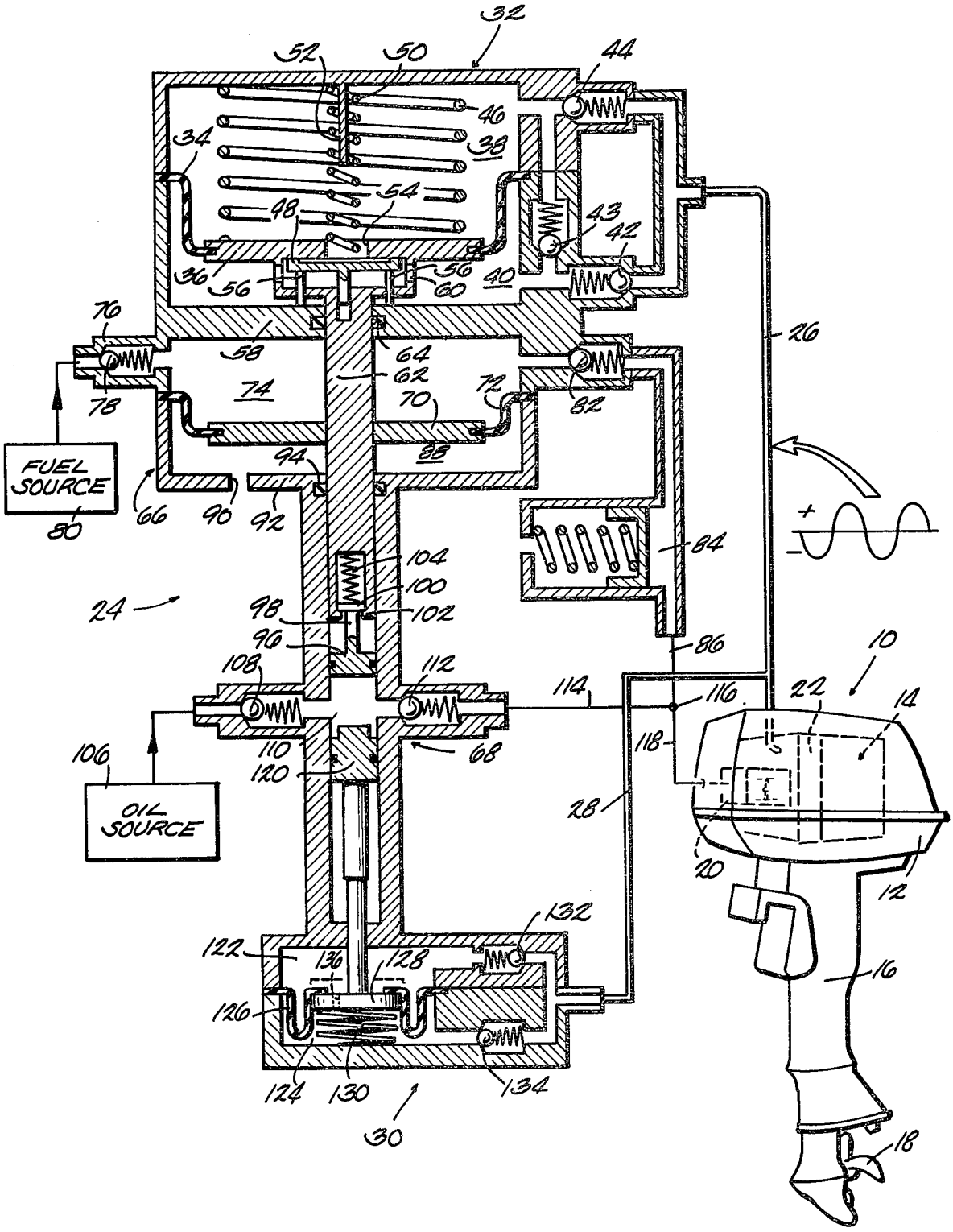
FUEL SOURCE
OIL SOURCE

PRESSURE-CONTROLLED STROKE LIMITER

BACKGROUND OF THE INVENTION

Walsworth U.S. Pat. application Ser. No. 410,497 filed Aug. 23, 1982 discloses a reciprocating fuel and oil pump in which the volume of oil pumped is variable relative to the fuel delivered. This permits the fuel to oil ratio to be varied to better suit the operating requirements of a two-stroke internal combustion engine. The oil pump piston of the fuel and oil pump has a variable stroke with the stroke being decreased by engagement with a stop positioned by means linked to the throttle linkage. The need for linkage between the throttle and the adjustable stop may impose design restraints.

SUMMARY OF THE INVENTION

This invention provides a two-stroke internal combustion engine of the type having separate fuel and oil pumps delivering their outputs for mixture prior to entering the carburetor, said oil pump having a variable output relative to the fuel pump output, the improvement comprising means responsive to the amplitude of the pressure wave in the engine crankcase to vary the output of the oil pump to optimize the fuel/oil ratio for the operating conditions.

The invention also provides a two-stroke internal combustion engine having carburetor, a fuel pump delivering fuel to the carburetor, a reciprocating oil pump delivering oil for mixture with the fuel in a ratio dependent upon the quantities of fuel and oil being delivered, means for varying the delivery of the oil pump relative to the delivery of the fuel pump to vary the ratio to suit the operating conditions of the engine, the pressure in the engine crankcase varying in a wave pattern with the amplitude of the waves being a function of engine operating conditions, and motor means responsive to the amplitude of said wave pattern to control said means for varying the stroke of the oil pump, said motor means including a housing having an interior which is divided into high and low pressure chambers by a movable wall, conduit means connecting the engine crankcase to the chambers and including first valve means to apply the high pressure component of said pressure wave to the high pressure chamber and second valve means to apply the low pressure component of the pressure wave to the high pressure chamber and second valve means to apply the low pressure component of the pressure wave to the low pressure chamber, said movable wall being moved by the pressure across the wall and acting to modify the delivery of the oil pump.

The invention also provides means responsive to the amplitude of the crankcase pressure wave to modify the output of the oil pump relative to the fuel pump supplying a two-stroke engine to thereby vary the fuel/oil ratio in accordance with engine operating conditions. The concept is applicable to various oil pumps.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

BRIEF DESCRIPTION OF THE DRAWING

The single FIGURE of drawings is a schematic showing of the present invention.

DETAILED DESCRIPTION OF THE INVENTION

The outboard motor 10 includes a power head 12 incorporating a two-stroke internal combustion engine 14. Lower unit 16 is secured to the power head 12 and supports a propeller 18 driven by the engine.

The engine includes a carburetor 20 for feeding a fuel/oil mixture to the crankcase 22 of the engine for subsequent induction into the cylinders of the engine. It may be noted that the pressure in the crankcase 22 varies in a wave pattern, the amplitude of which is related to the operating condition of the engine and to the throttle setting. The pressure wave may vary between −3 psi and +3 psi at idle speed, for example, thus giving an amplitude of 6 psi. At high speed operation, the wave pattern may vary between +5 and −6, for example, or +10 and −1, for example, either of which would have an amplitude of 11 psi. This wave pattern is used to indicate the operating condition of the engine and to control the amount of oil delivered to the engine relative to the amount of fuel to permit the fuel-/oil mixutre to be varied to suit the engine operating conditions. The pressure wave is also used to actuate the fuel/oil pump, although any suitable means for developing a reciprocating motion or other pumping action can be utilized. So far as the pressure wave is concerned, and particularly the high and low pressure or amplitude, it may be noted that this terminology may embrace two positive pressures, or two negative pressures in addition to the plus and minus pressures already mentioned.

As indicated, the invention embraces a fuel/oil pump 24 which separately pumps fuel and oil for subsequent mixture prior to entering the carburetor. This, of course, differs from the typical two-stroke engine in which the fuel and oil are mixed in a predetermined ratio in a tank from which the mixture is then drawn for delivery to the carburetor and engine.

The oil and fuel pump and the method of actuating the pump are fully disclosed in U.S. Pat. application Ser. No. 410,497 along with several variations thereon. For the purpose of understanding the present invention, it need be only understood that the pressure in the crankcase 22 is sensed through conduit 26 which has a branch 28 leading to a pressure controlled stroke limiter 30 which will be fully described hereinafter.

The main condudit 26 communicates with a pressure responsive motor section 32 having diaphragm 34 and diaphragm pad 36 separating the motor into upper and lower chambers 38, 40 respectively. The positive pressure portion of the pressure wave in conduit 26 passes spring loaded check valve 42 into the lower chamber while the negative pressure wave can cause check valve 44 to unseat and permit the pressure in the upper chamber 38 to be reduced. Thus, there is a pressure differential established across the diaphragm and pad assembly causing the diaphragm pad to move upwardly against the bias of spring 46. Spring loaded by-pass valves 43 prevents excessive pressure in the high side by bleeding pressure to the low side.

Pressure acting across the valve member 48 holds the member 48 against the under side of the diaphragm pad 36 against the force of the light spring 50 to prevent leakage of pressure from the high to low pressure chamber 40, 38. Thus, the diaphragm moves upwardly against the spring 46 until the depending finger 52 strikes valve member 48 to unseat the valve member and permit the pressure to start to equalize across the diaphragm pad. At this time the light spring 50 will push the valve member 48 to its lower limit of travel and hold the valve away from the port 54 until the spring 46 has driven the pad to where the fingers or bosses 56 depending from the under side of valve 48 strike the partition 58 and prevents further downward movement of valve 48. The pad 36 continues down and strikes the valve and the pressure can now be re-established to hold valve 48 against the pad 36. Thus, the pressure differential derived from the engine crankcase is utilized to develop a reciprocating action of the diaphragm pad 36. This motion will be at a substantially slower rate than the frequency of the pressure wave occurring in the engine crankcase.

The cage 60 depending from diaphragm pad 36 is provided with a central rod 62 which passes through the partition 58 and is sealed relative thereto by O-ring 64. This rod now will transmit the reciprocating motion to the fuel pump section 66 and the oil pump section 68. In the fuel pump section, the rod 62 is connected to diaphragm pad 70 which will move up and down in the fuel pump section. The perimeter of the pad 70 is connected to the wall of the fuel pump section by a diaphragm 72. The chamber 74 above the diaphragm and pad 72, 70 constitutes a fuel pump chamber having a fuel inlet 76 in which the spring loaded check valve 78 is located. The inlet communicates with the fuel source or tank 80. The outlet of the chamber 74 passes through check valve 82 and then communicates with a surge chamber 84 and conduit 86 leading to the carburetor 20. The chamber 88 under the fuel diaphragm 72 is vented to atmosphere through vent 90. The rod 62 extends past the lower wall 92 of the fuel pump section and is sealed relative thereto by O-ring 94.

The lower end of rod 62 has an oil pumping piston 96 connected thereto through a lost motion connection comprising piston pin 98 projecting through the opening in the lower end of rod 62 with the pin head 100 captured above internal shoulder 102 on the lower end of the rod. The spring 104 is a stiff spring which normally holds the piston in the lowermost position as illustrated. Therefore, the piston reciprocates as rod 62 reciprocates. As the piston moves upwardly, oil will be drawn from the tank or source 106 past the spring loaded check valve 108 into chamber 110. As the piston moves downwardly, the check valve 108 will close and spring loaded check valve 112 will open to allow oil to be delivered through conduit 114 to the junction 116 with the fuel line. It is at this point that the fuel and oil mix are delivered through line 118 to the carburetor 20.

It will be noted that there is an adjustable stop 120 positioned in alignment with the piston 96 but opposite the cross bore between the inlet 108 and outlet 112. If this adjustable stop is moved upwardly sufficiently to restrict movement of the piston 96 as rod 62 comes down, the lost motion between the piston and the rod then comes into play and the spring 104 is compressed while the stroke of the piston is restricted or shortened, thus decreasing the amount of oil delivered during the stroke of the fuel pump which is still making a full stroke.

In the aforesaid co-pending U.S. Pat. application Ser. No. 410,497, the adjustable stop 120 is positioned by means of a cam actuated through linkage connected with the throttle. Thus, when the throttle was in the idle position, the stop would move to restrict delivery and permit the fuel/oil mixture to lean out. When the throttle was moved towards full throttle, the fuel/oil mixture was enriched by retracting the stop and permitting the full stroke of piston 96. That arrangement, however, required the fuel pump to be located where it could be mechanically interconnected through linkage. The present arrangement positions the stop 120 under control of a stroke limiter 30 responsive to the amplitude of the crankcase pressure wave. This means only tubing is needed to interconnect the stroke limiter and engine. As a consequence the fuel pump can be located remote from the throttle linkage and there is more flexibility in location.

As previously indicated, the conduit 26 connected to the crankcase to sense the pressure wave has a branch 28 leading to limiter 30 which comprises a housing having an upper chamber 122 separated from a lower chamber 124 by diaphragm 126 and pad 128. The pad is biased upwardly by spring 130. Positive pressure waves coming into the limiter housing through conduit 28 will unseat the spring loaded check valve 132 and pass into chamber 122 while the negative pressure portion of the waves will unseat the check valve 134 and reduce the pressure in chamber 124 under diaphragm 126. Therefore, a positive to negative pressure gradient is established across the diaphragm from chamber 122 to 124 and will move the pad 128 downwardly against the bias of spring 130. The center of the diaphragm pad is connected to the adjustable stop 120 and positions the stop. It will be appreciated that the greater the pressure differential (as associated with full throttle) the more the pad 128 will be moved downwardly against the force of the spring 130 and, therefore, the greater will be the effective stroke of piston 96 which means more oil delivered in relation to the fuel delivered, thus enriching the mixture.

A small vent or bleed hole 136 passes through the diaphragm pad 128 to prevent the pressure differential being trapped, in effect, across the pad and taking away control. With the bleed hole the pressure will always tend to equalize, but at a slow rate. The small vent is adequate to prevent the pad from locking up.

The compressed spring 130 can have a variable spring rate or a multiplicity of springs can be employed, if desired, to more closely control the position of the adjustable stop relative to the operating condition of the engine. It will be understood the pressure wave of the crankcase pressure is a characteristic of each particular engine design and all two-stroke engines have a characteristic pressure wave. This invention uses the pressure wave to position the stop and control the oil delivery. This arrangement will work in conjunction with other fuel pumps. The oil delivery can be varied in accordance with the amplitude of the pressure wave while the fuel delivery remains constant, thus enabling the fuel/oil ratio to be varied.

It will be apparent that consumption of the fuel/oil mixture is determined by the throttle setting. The fuel and oil pump will stall when consumption is less than the capacity of the pump. Preferably, the point where the fuel and oil mix should be close to the carburetor so the mixture closely follows the operating conditions.

We claim:

1. A two-stroke internal combustion engine having a carburetor, a fuel pump delivering fuel to the carburetor, an oil pump delivering oil for mixture with the fuel in a ratio dependent upon the quantities of fuel and oil being delivered, means for varying the delivery of the oil pump relative to the delivery of the fuel pump to vary the ratio to suit the operating conditions of the engine, the pressure in the engine crankcase varying in a wave pattern with the amplitude of the waves being a function of engine operating conditions, and means responsive to the amplitude of said wave pattern for controlling said means for varying the delivery of the oil pump.

2. An internal combustion engine according to claim 1 in which the means responsive to the amplitude of the wave pattern comprises motor means moved in accordance with the pressure difference between the peaks and valleys in said wave pattern.

3. An internal combustion engine according to claim 2 in which the oil pump has a reciprocating action and the means for varying the delivery of the oil pump acts to vary the pumping or delivery stroke of the oil pump.

4. An internal combustion engine according to claim 3 in which the means for varying the delivery of the oil pump is controlled by said motor means.

5. An internal combustion engine according to claim 4 in which the oil pump includes a reciprocating drive member and a pump piston having a lost motion connection to the drive member, spring means biasing the piston to take up the lost motion and yieldable to permit lost motion to occur when movement of the piston in the delivery direction is prevented, said means varying the delivery of the oil pump comprising a stop movable into position to be engaged by and prevent movement of the piston in the delivery direction, said stop being positioned by said motor means.

6. An internal combustion engine according to claim 5 in which said fuel pump has a reciprocating action and the fuel pump and said drive member in said oil pump are reciprocated by a common drive means which imparts the same length stroke to each.

7. An internal combustion engine according to claim 2 in which the motor means comprises a housing the interior of which is divided into high and low pressure chambers by a movable wall, conduit means connecting the engine crankcase to the chambers and including first valve means to apply the high pressure component of said pressure wave to the high pressure chamber and second valve means to apply the low pressure component of the pressure wave to the low pressure chamber, said movable wall being moved by the pressure across the wall and acting to modify the delivery of the oil pump.

8. An internal combusion engine according to claim 7 in which the oil pump has a reciprocating action including a variable stroke piston, stop means engageable by the piston to limit the piston stroke, said stop means being connected to and positioned by the movable wall of said motor means.

9. A two-stroke internal combustion engine of the type having separate fuel and oil pumps delivering their outputs for mixture prior to entering the carburetor, said oil pump having a variable output relative to the fuel pump output, the improvement comprising, means responsive to the amplitude of the pressure wave in the engine crankcase to vary the output of the oil pump to optimize the fuel/oil ratio for the operating conditions.

10. A two-stroke internal combustion engine including a carburetor for mixing the fuel and oil mix with air for delivery to the cylinders, the pressure in the crankcase of the engine varying in a wave pattern having an amplitude related to the engine speed, fuel pump means for delivering fuel to the carburetor, oil pump means for delivering oil to the carburetor for mixture with the fuel, the oil pump means having a variable stroke to vary the oil delivery relative to the fuel delivered by the fuel pump means to vary the fuel to oil ratio in the mix, and means responsive to the amplitude of the crankcase pressure waves to control the stroke of the oil pump.

* * * * *